US011090973B2

(12) United States Patent
Valero

(10) Patent No.: US 11,090,973 B2
(45) Date of Patent: Aug. 17, 2021

(54) PAINT TRAY ASSEMBLY

(71) Applicant: Douglas Valero, Follansbee, WV (US)

(72) Inventor: Douglas Valero, Follansbee, WV (US)

( * ) Notice: Subject to any disclaimer, the term of this patent is extended or adjusted under 35 U.S.C. 154(b) by 753 days.

(21) Appl. No.: 15/974,690

(22) Filed: May 9, 2018

(65) Prior Publication Data

US 2019/0344611 A1 Nov. 14, 2019

(51) Int. Cl.

| | |
|---|---|
| ***B44D 3/12*** | (2006.01) |
| ***B44D 3/14*** | (2006.01) |
| ***E06C 7/14*** | (2006.01) |
| ***B65D 25/22*** | (2006.01) |

(52) U.S. Cl.

CPC ..... *B44D 3/126* (2013.01); *B44D 3/128* (2013.01); *B44D 3/14* (2013.01); *B65D 25/22* (2013.01); *E06C 7/14* (2013.01)

(58) Field of Classification Search

CPC ..... B44D 3/126; B44D 3/128; B44D 3/14; B44D 3/16; B44D 3/006; E06C 7/143; E06C 7/14; B65D 25/28; B65D 25/22; B65D 25/24; B25G 1/102

USPC ..... 220/696, 695, 736, 735, 570, 628, 630, 220/756, 755, 752; 15/236.03; 16/110.1, 16/430

See application file for complete search history.

(56) References Cited

U.S. PATENT DOCUMENTS

| | | | | |
|---|---|---|---|---|
| 2,661,858 | A * | 12/1953 | Howell | B44D 3/126 15/257.06 |
| 2,887,705 | A * | 5/1959 | Serwer | B44D 3/126 15/257.06 |
| 2,908,468 | A * | 10/1959 | Thomas | B44D 3/14 248/210 |
| 3,593,951 | A | 7/1971 | Warner | |
| 4,023,702 | A | 5/1977 | McKnight | |
| 4,205,411 | A | 6/1980 | Cupp | |
| 5,511,279 | A * | 4/1996 | Ippolito | B44D 3/126 15/257.06 |
| 5,533,228 | A * | 7/1996 | Jarecki | B44D 3/126 15/257.06 |
| 5,836,043 | A | 11/1998 | Rovas | |
| D444,604 | S | 7/2001 | Hoffert | |
| 6,332,556 | B1 | 12/2001 | Shalman | |
| 6,705,480 | B1 | 3/2004 | Saddler | |
| 7,621,017 | B2 * | 11/2009 | Cornelissen | B44D 3/126 15/257.06 |
| 2004/0195248 | A1 * | 10/2004 | Garcia | B05C 17/0245 220/570 |
| 2004/0206761 | A1 * | 10/2004 | Frantz | B44D 3/126 220/570 |

(Continued)

*Primary Examiner* — Robert J Hicks

(57) ABSTRACT

A paint tray assembly for use with a paint roller includes a pan. The pan has a top that is open so that the pan is configured to position paint. A first plate is coupled to and extends transversely from an upper perimeter of the pan. An edge of the first plate is distal to the pan and elevated relative to the upper perimeter. The first plate is configured to direct excess paint from a roller to the pan. A rod is coupled to and extends transversely from a lower surface of the first plate proximate to the pan. A lower terminus of the rod is substantially coplanar with a bottom of the pan. The rod is positioned to stabilize the pan on a substantially horizontal surface. The rod also is configured to be grasped in a hand of a user to lift the pan.

18 Claims, 6 Drawing Sheets

(56) References Cited

U.S. PATENT DOCUMENTS

2006/0225959 A1* 10/2006 Pohl ..... B44D 3/126
182/129
2019/0299395 A1* 10/2019 Macauda ..... B65D 25/2802

* cited by examiner

PAINT TRAY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tray assemblies and more particularly pertains to a new tray assembly for use with a paint roller.

BRIEF SUMMARY OF THE INVENTION

An embodiment of the disclosure meets the needs presented above by generally comprising a pan. The pan has a top that is open so that the pan is configured to position paint. A first plate is coupled to and extends transversely from an upper perimeter of the pan. An edge of the first plate is distal to the pan and elevated relative to the upper perimeter. The first plate is configured to direct excess paint from a roller to the pan. A rod is coupled to and extends transversely from a lower surface of the first plate proximate to the pan. A lower terminus of the rod is substantially coplanar with a bottom of the pan. The rod is positioned to stabilize the pan on a substantially horizontal surface. The rod also is configured to be grasped in a hand of a user to lift the pan.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
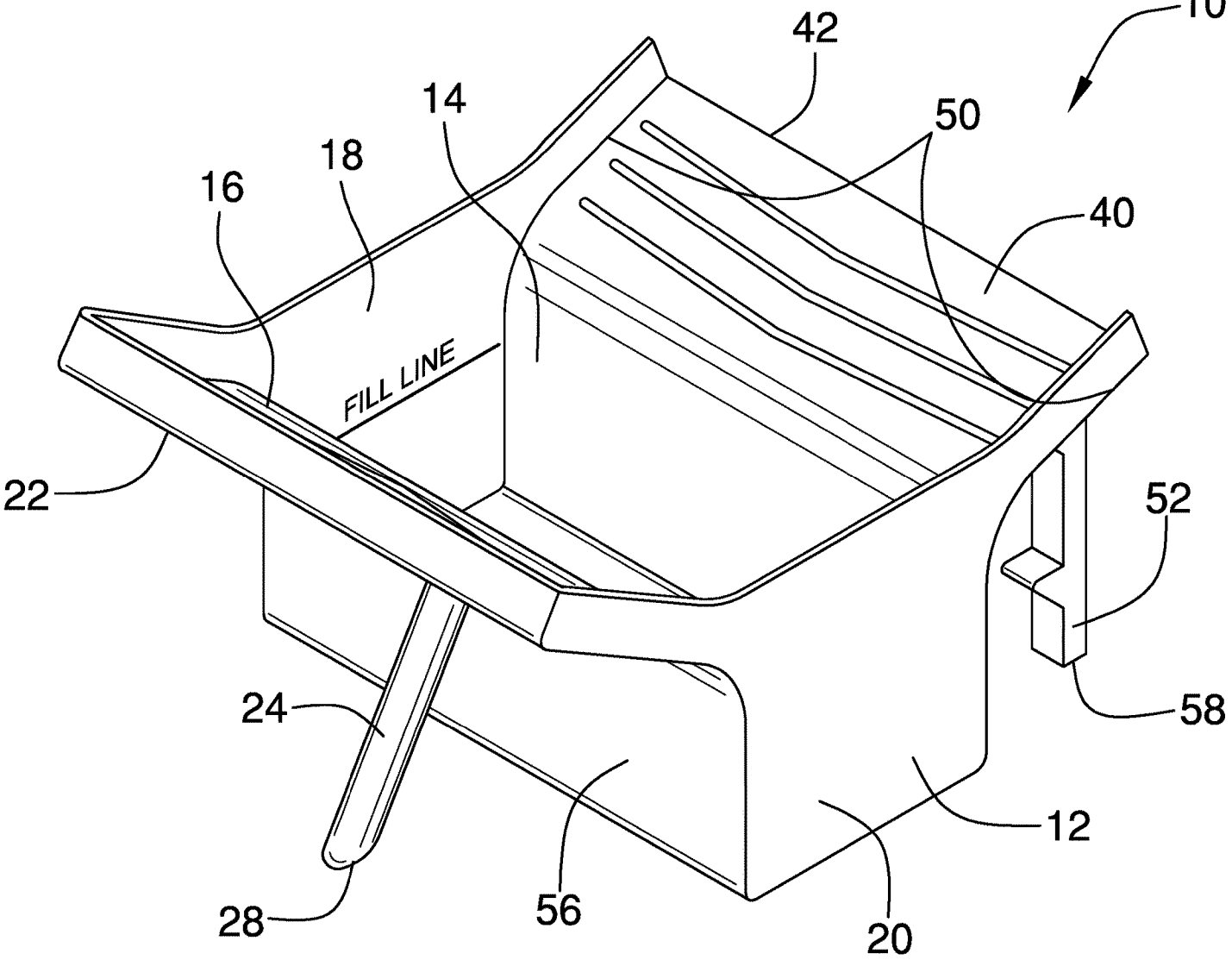
FIG. 1 is an isometric perspective view of a paint tray assembly according to an embodiment of the disclosure.

With reference now to the drawings, and in particular to FIGS. 1 through 6 thereof, a new tray assembly embodying the principles and concepts of an embodiment of the disclosure and generally designated by the reference numeral 10 will be described.

As best illustrated in FIGS. 1 through 6, the paint tray assembly 10 generally comprises a pan 12. The pan 12 is rectangularly box shaped. The pan 12 has a top 14 that is open so that the pan 12 is configured to position paint.

Figure 2:
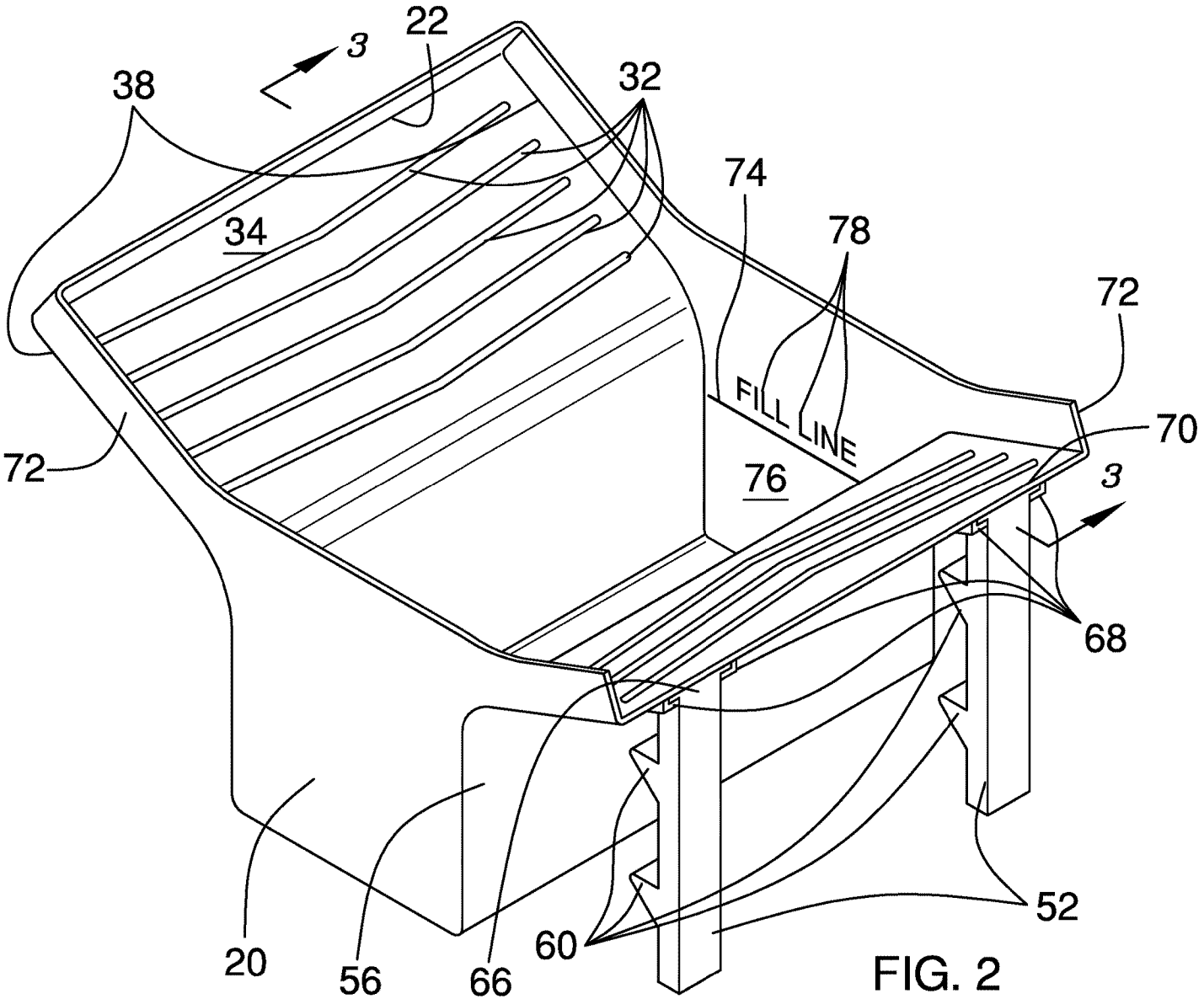
FIG. 2 is an isometric perspective view of an embodiment of the disclosure.

A first plate 16 is coupled to and extends transversely from an upper perimeter 18 of the pan 12, as shown in FIG. 2. The first plate 16 is rectangularly shaped and extends between opposing ends 20 of the pan 12. An edge 22 of the first plate 16 that is distal to the pan 12 is elevated relative to the upper perimeter 18 so that the first plate 16 is configured to direct excess paint from a roller to the pan 12.

Figure 3:
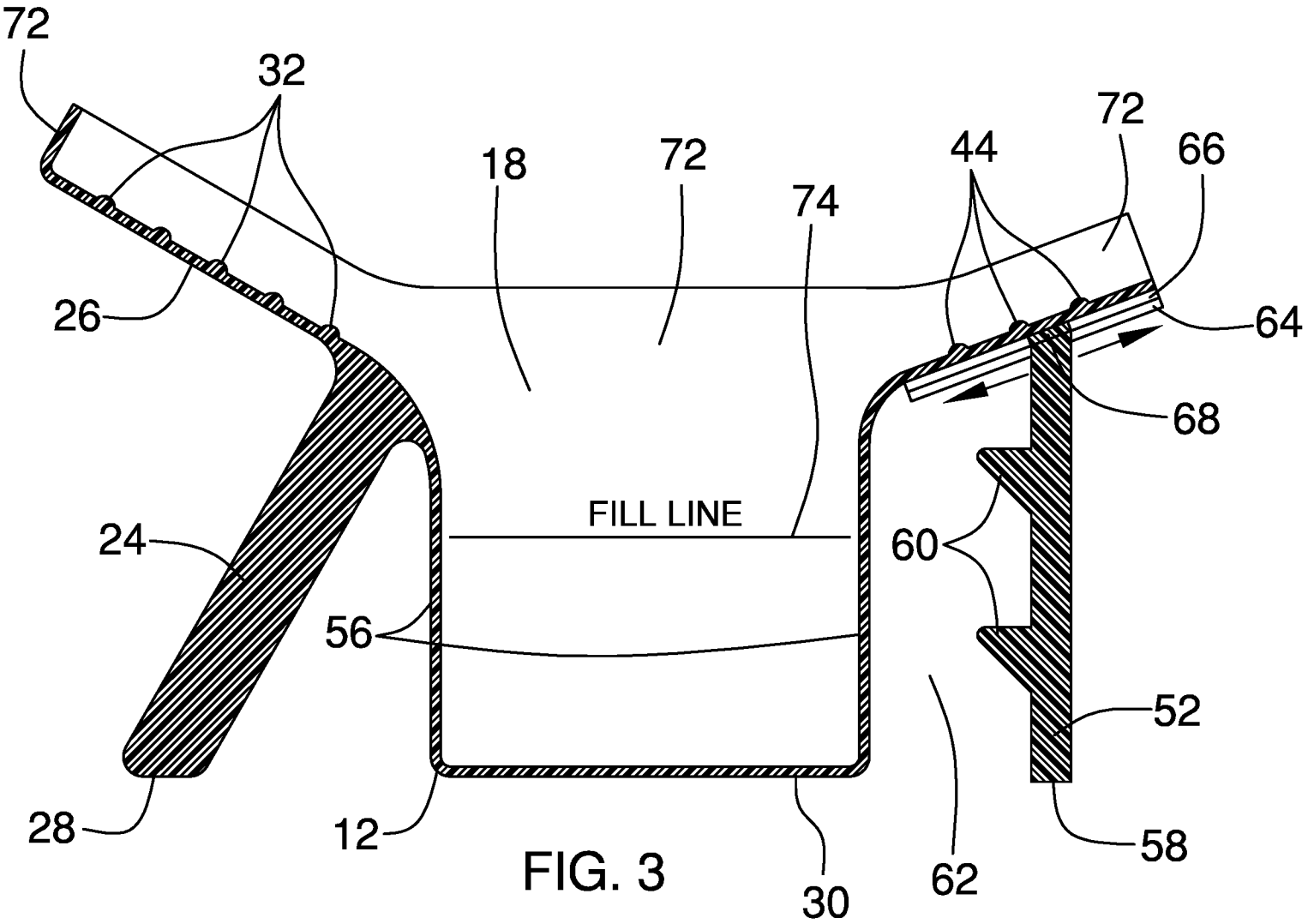
FIG. 3 is a cross-sectional view of an embodiment of the disclosure.
Figure 4:
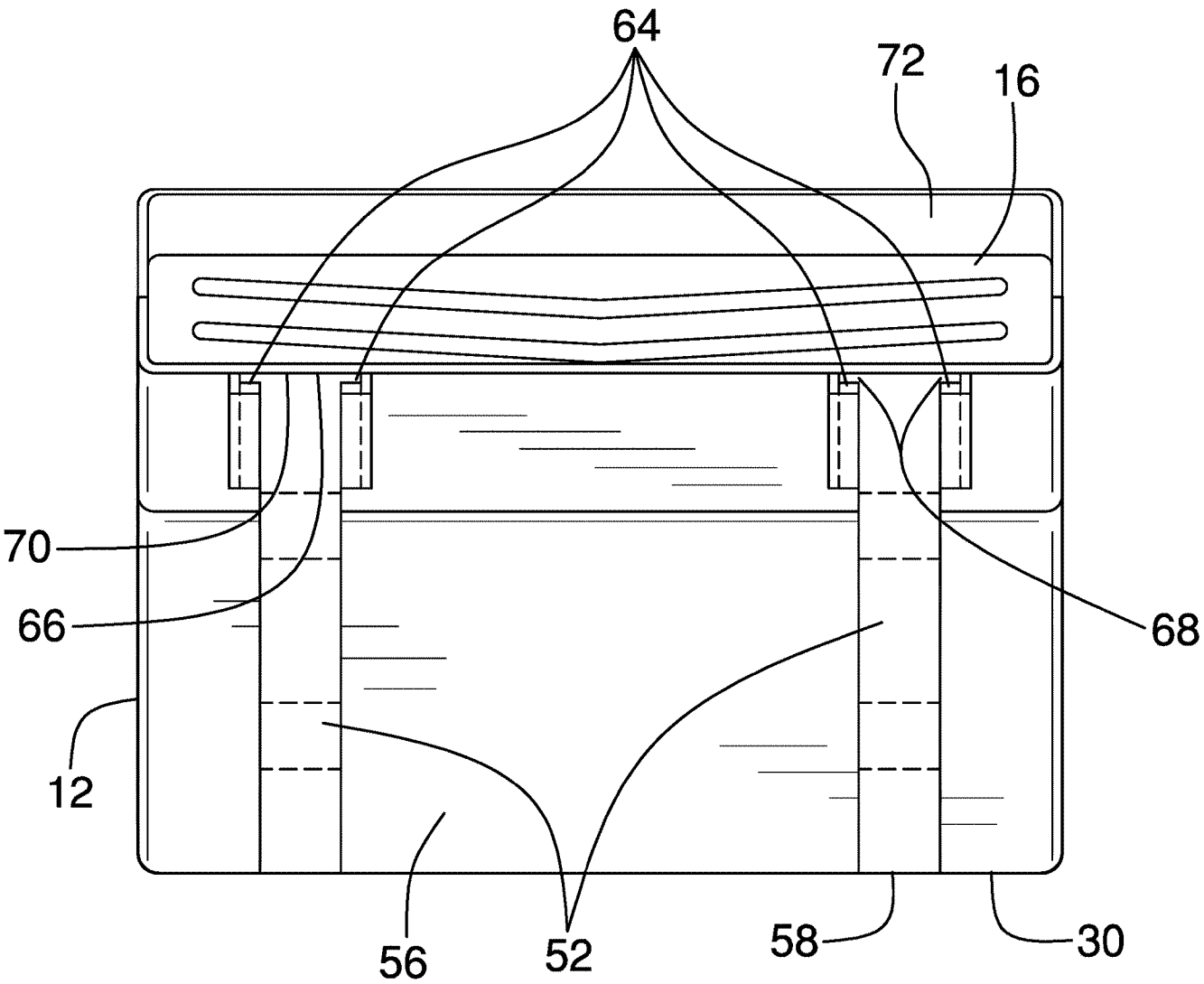
FIG. 4 is a side view of an embodiment of the disclosure.

A rod 24 is coupled to and extends transversely from a lower surface 26 of the first plate 16 proximate to the pan 12, as shown in FIG. 3. The rod 24 is circularly shaped when viewed longitudinally. A lower terminus 28 of the rod 24 is substantially coplanar with a bottom 30 of the pan 12. The lower terminus 28 of the rod 24 is tapered so that the lower terminus 28 is configured to be positioned flush to a substantially horizontal surface, as shown in FIG. 3. The rod 24 is positioned to stabilize the pan 12 on the substantially horizontal surface. The rod 24 also is configured to be grasped in a hand of a user to lift the pan 12.

Figure 5:
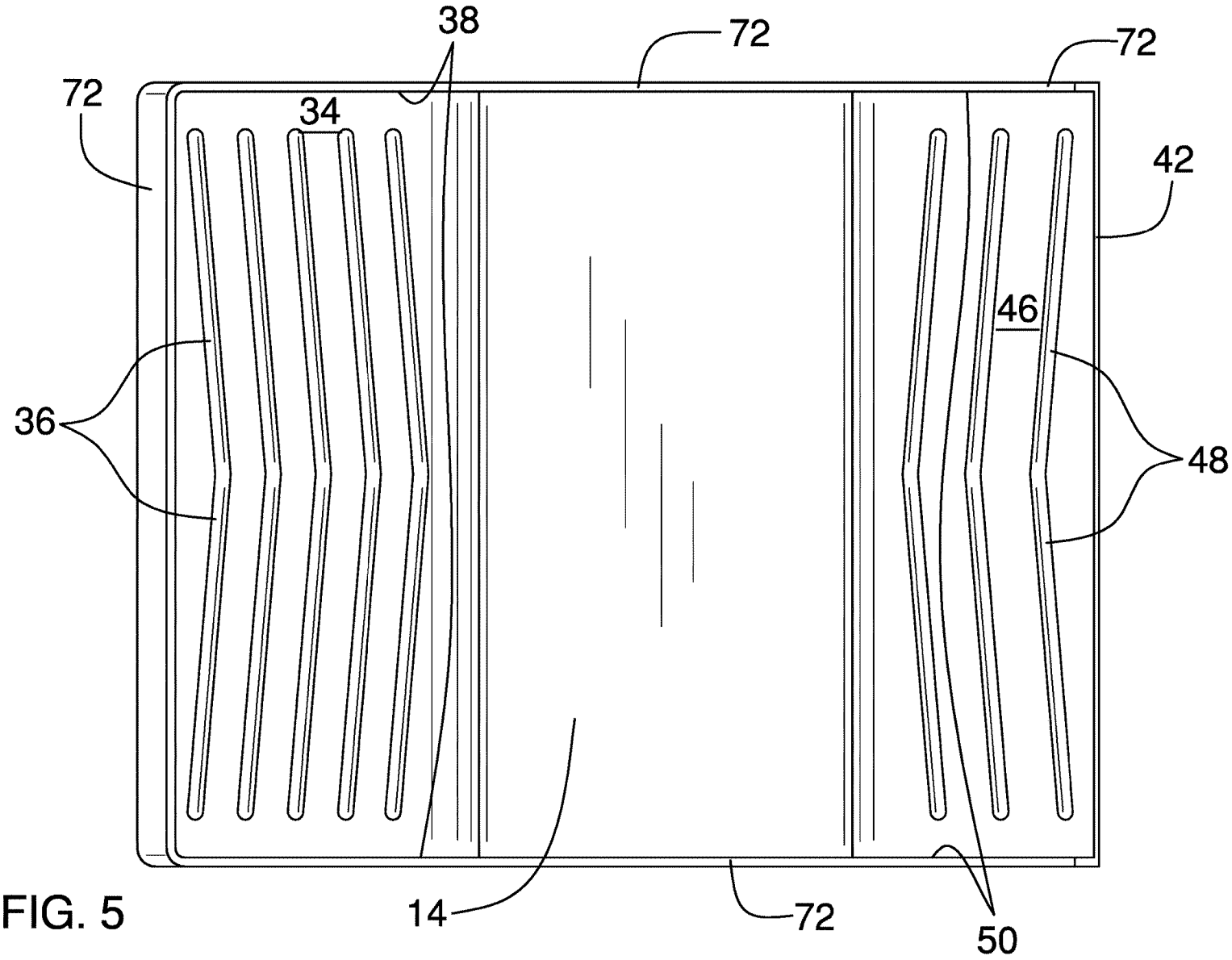
FIG. 5 is a top view of an embodiment of the disclosure.
Figure 6:
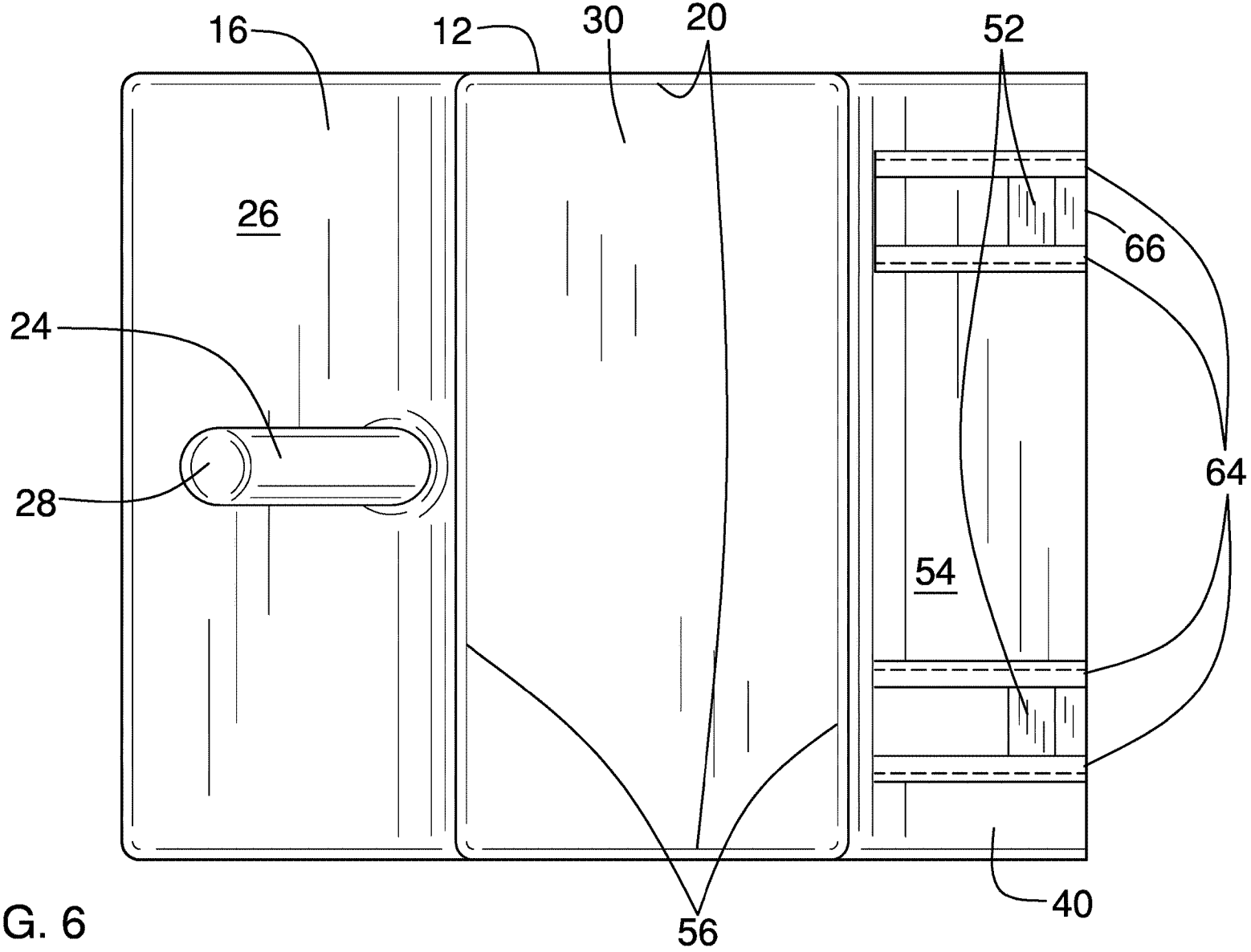
FIG. 6 is a bottom view of an embodiment of the disclosure.

A plurality of ridges 32 is coupled to and extends from an upper surface 34 of the first plate 16. The plurality of ridges 32 comprises five ridges 32. Each ridge 32 comprises a pair of sections 36. Each section 36 extends angularly from proximate to a respective opposing edge 38 toward the pan 12, as shown in FIG. 5. The pair of sections 36 intersects equally distant from opposing edges 38 of the first plate 16. The ridges 32 are configured to strip paint from the roller as the roller is motivated along the first plate 16 from the edge 22 toward the pan 12. The plurality of ridges 32 is positioned to direct the excess paint from the roller to the pan 12.

A second plate 40 is coupled to and extends transversely from the upper perimeter 18 of the pan 12, as shown in FIG. 2. The second plate 40 is rectangularly shaped and extends between the opposing ends 20 of the pan 12. The second plate 40 is opposingly positioned on the upper perimeter 18 relative to the first plate 16. An endpoint 42 of the second plate 40 that is distal to the pan 12 is elevated relative to the upper perimeter 18 so that the second plate 40 is configured to direct the excess paint from the roller to the pan 12.

A plurality of ribs 44 is coupled to and extends from an upper face 46 of the second plate 40. The plurality of ribs 44 comprises three ribs 44. Each rib 44 comprises a pair of segments 48. Each segment 48 extends angularly from proximate to a respective opposing side edge 50 of the second plate 40 toward the pan 12, as shown in FIG. 5. The pair of segments 48 intersects equally distant from the opposing side edges 50 of the second plate 40. The ribs 44 are configured to strip paint from the roller as the roller is motivated along the second plate 40 from the endpoint 42 toward the pan 12. The plurality of ribs 44 is positioned to direct the excess paint from the roller to the pan 12.

Each of a pair of bars 52 is coupled to and extends from a lower face 54 of the second plate 40, as shown in FIG. 2. The pair of bars 52 is parallel to a respective opposing side 56 of the pan 12, as shown in FIG. 3. A lower end 58 of each bar 52 is substantially coplanar with the bottom 30 of the pan 12 so that the pair of bars 52 is positioned to stabilize the pan 12 on the substantially horizontal surface.

Each of a plurality of extrusions 60 is coupled to a respective bar 52 and extends toward the respective opposing side 56 of the pan 12, as shown in FIG. 3. The plurality of extrusions 60 comprises four extrusions 60 that are positioned two apiece on each bar 52. The extrusions 60 are configured to selectively couple to a step of a ladder that is inserted into a gap 62 defined by the respective opposing side 56 of the pan 12, the second plate 40, and the pair of bars 52.

Two pairs of brackets 64, which are L-shaped, are coupled to the lower face 54 of the second plate 40, as shown in FIG. 2. Each pair of brackets 64 extends from proximate to the pan 12 to the endpoint 42 and defines a respective slot 66. Each of two pairs of tabs 68 is coupled singly to and extends from an upper end 70 of an associated bar 52 so that each tab 68 is positioned within a respective bracket 64. The associated bar 52 is selectively slidable within a respective slot 66 and is selectively positionable relative to the respective opposing side 56 of the pan 12 to couple the associated bar 52 to the step of the ladder that is inserted into the gap 62.

A rim 72 is coupled to and extends upwardly from the edge 22 of the first plate 16, the opposing edges 38 of the first plate 16, and the opposing ends 20 of the pan 12, as shown in FIG. 2. The rim 72 is configured to retain the paint on the first plate 16 as the roller is motivated along the first plate 16 from the edge 22 toward the pan 12. The rim 72 also extends along the opposing side edges 50 of the second plate 40 to the endpoint 42 of the second plate 40. The rim 72 is configured to retain the paint on the second plate 40 as the roller is motivated along the second plate 40 from the endpoint 42 toward the pan 12.

A protrusion 74 is coupled to and extends from an inner surface 76 of the pan 12 proximate to the top 14 of the pan 12, as shown in FIG. 1. The protrusion 74 extends from the opposing sides 56 of the pan 12. Indicia 78 are coupled to the inner surface 76 of the pan 12 proximate to the protrusion 74 and are configured to label the protrusion 74. The protrusion 74 is configured to indicate a recommended level of paint that is to be positioned in the pan 12.

In use, the rod 24 and the pair of bars 52 are positioned to stabilize the pan 12 on the substantially horizontal surface. The rod 24 also is configured to be grasped in the hand of the user to lift the pan 12. The extrusions 60 are configured to selectively couple to the step of the ladder that is inserted into the gap 62 to couple the pan 12 to the ladder. The first plate 16 and the second plate 40 are configured to direct the excess paint from the roller to the pan 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint tray assembly comprising:

a pan, said pan having a top, said top being open wherein said pan is configured for positioning paint;

a first plate coupled to and extending transversely from an upper perimeter of said pan such that an edge of said first plate is distal to said pan and elevated relative to said upper perimeter wherein said first plate is configured for directing excess paint from a roller to said pan; and a rod coupled to and extending transversely from a lower surface of said first plate proximate to said pan such that a lower terminus of said rod is substantially coplanar with a bottom of said pan wherein said rod is positioned for stabilizing said pan on a substantially horizontal surface and wherein said rod is configured for grasping in a hand of a user for lifting said pan.

2. The assembly of claim 1, further including said pan being rectangularly box shaped.

3. The assembly of claim 2, further including said first plate being rectangularly shaped, said first plate extending between opposing ends of said pan.

4. The assembly of claim 1, further including said lower terminus of said rod being tapered such that said lower terminus is configured for being positioned flush to the substantially horizontal surface, said rod being circularly shaped when viewed longitudinally.

5. The assembly of claim 1, further including a plurality of ridges coupled to and extending from an upper surface of said first plate wherein said ridges are configured for stripping paint from the roller as the roller is motivated along said first plate from said edge toward said pan.

6. The assembly of claim 5, further including said plurality of ridges comprising five said ridges, each said ridge comprising a pair of sections, each said section extending angularly from proximate to a respective opposing edge toward said pan such that said pair of sections intersects equally distant from opposing edges of said first plate positioning said plurality of ridges for directing the excess paint from the roller to said pan.

7. The assembly of claim 3, further including a second plate coupled to and extending transversely from said upper perimeter of said pan such that an endpoint of said second plate is distal to said pan and elevated relative to said upper perimeter wherein said second plate is configured for directing the excess paint from the roller to said pan.

8. The assembly of claim 7, further including said second plate being opposingly positioned on said upper perimeter relative to said first plate, said second plate being rectangularly shaped, said second plate extending between said opposing ends of said pan.

9. The assembly of claim 7, further including a plurality of ribs coupled to and extending from an upper face of said second plate wherein said ribs are configured for stripping paint from the roller as the roller is motivated along said second plate from said endpoint toward said pan.

10. The assembly of claim 9, further including said plurality of ribs comprising three said ribs, each said rib comprising a pair of segments, each said segment extending angularly from proximate to a respective opposing side edge of said second plate toward said pan such that said pair of segments intersects equally distant from said opposing side edges of said second plate positioning said plurality of ribs for directing the excess paint from the roller to said pan.

11. The assembly of claim 8, further comprising:

a pair of bars coupled to and extending from a lower face of said second plate, said pair of bars being parallel to a respective opposing side of said pan such that a lower end of each said bar is substantially coplanar with said bottom of said pan wherein said pair of bars is positioned for stabilizing said pan on the substantially horizontal surface; and a plurality of extrusions, each said extrusion being coupled to a respective said bar and extending toward said respective opposing side of said pan wherein said extrusions are configured for selectively coupling to a step of a ladder inserted into a gap defined by said respective said opposing side of said pan, said second plate, and said pair of bars.

12. The assembly of claim 11, further including said plurality of extrusions comprising four said extrusions positioned two apiece on each said bar.

13. The assembly of claim 11, further comprising:

two pairs of brackets, said brackets being L-shaped, each said pair of brackets being coupled to said lower face of said second plate and extending from proximate to said pan to said endpoint defining a respective slot; and two pairs of tabs, each said pair of tabs being coupled singly to and extending from an upper end of an associated said bar such that each of said tabs is positioned within a respective said bracket wherein said associated said bar is selectively slidable within a respective said slot and selectively positionable relative to said respective said opposing side of said pan for coupling said associated said bar to the step of the ladder inserted into said gap.

14. The assembly of claim 8, further including a rim coupled to and extending upwardly from said edge of said first plate, opposing edges of said first plate, and said opposing ends of said pan wherein said rim is configured for retaining the paint on said first plate as the roller is motivated along said first plate from said edge toward said pan.

15. The assembly of claim 14, further including said rim extending along opposing side edges of said second plate to said endpoint of said second plate wherein said rim is configured for retaining the paint on said second plate as the roller is motivated along said second plate from said endpoint toward said pan.

16. The assembly of claim 1, further including a protrusion coupled to and extending from an inner surface of said pan proximate to said top of said pan wherein said protrusion is configured for indicating a recommended level of paint to be positioned in said pan, said protrusion extending from opposing sides of said pan.

17. The assembly of claim 16 further including indicia coupled to said inner surface of said pan proximate to said protrusion wherein said indicia are configured for labeling said protrusion.

18. A paint tray assembly comprising:

a pan, said pan having a top, said top being open wherein said pan is configured for positioning paint, said pan being rectangularly box shaped;

a first plate coupled to and extending transversely from an upper perimeter of said pan such that an edge of said first plate is distal to said pan and elevated relative to said upper perimeter wherein said first plate is configured for directing excess paint from a roller to said pan, said first plate being rectangularly shaped, said first plate extending between opposing ends of said pan;

a rod coupled to and extending transversely from a lower surface of said first plate proximate to said pan such that a lower terminus of said rod is substantially coplanar with a bottom of said pan wherein said rod is positioned for stabilizing said pan on a substantially horizontal surface and wherein said rod is configured for grasping in a hand of a user for lifting said pan, said lower terminus of said rod being tapered such that said lower terminus is configured for being positioned flush to the substantially horizontal surface, said rod being circularly shaped when viewed longitudinally;

a plurality of ridges coupled to and extending from an upper surface of said first plate wherein said ridges are configured for stripping paint from the roller as the roller is motivated along said first plate from said edge toward said pan, said plurality of ridges comprising five said ridges, each said ridge comprising a pair of sections, each said section extending angularly from proximate to a respective opposing edge toward said pan such that said pair of sections intersects equally distant from opposing edges of said first plate positioning said plurality of ridges for directing the excess paint from the roller to said pan;

a second plate coupled to and extending transversely from said upper perimeter of said pan such that an endpoint of said second plate is distal to said pan and elevated relative to said upper perimeter wherein said second plate is configured for directing the excess paint from the roller to said pan, said second plate being opposingly positioned on said upper perimeter relative to said first plate, said second plate being rectangularly shaped, said second plate extending between said opposing ends of said pan;

a plurality of ribs coupled to and extending from an upper face of said second plate wherein said ribs are configured for stripping paint from the roller as the roller is motivated along said second plate from said endpoint toward said pan, said plurality of ribs comprising three said ribs, each said rib comprising a pair of segments, each said segment extending angularly from proximate to a respective opposing side edge of said second plate toward said pan such that said pair of segments intersects equally distant from said opposing side edges of said second plate positioning said plurality of ribs for directing the excess paint from the roller to said pan;

a pair of bars coupled to and extending from a lower face of said second plate, said pair of bars being parallel to a respective opposing side of said pan such that a lower end of each said bar is substantially coplanar with said bottom of said pan wherein said pair of bars is positioned for stabilizing said pan on the substantially horizontal surface;

a plurality of extrusions, each said extrusion being coupled to a respective said bar and extending toward said respective opposing side of said pan wherein said extrusions are configured for selectively coupling to a step of a ladder inserted into a gap defined by said respective said opposing side of said pan, said second plate, and said pair of bars, said plurality of extrusions comprising four said extrusions positioned two apiece on each said bar;

two pairs of brackets, said brackets being L-shaped, each said pair of brackets being coupled to said lower face of said second plate and extending from proximate to said pan to said endpoint defining a respective slot;

two pairs of tabs, each said pair of tabs being coupled singly to and extending from an upper end of an associated said bar such that each of said tabs is positioned within a respective said bracket wherein said associated said bar is selectively slidable within a respective said slot and selectively positionable relative to said respective said opposing side of said pan for coupling said associated said bar to the step of the ladder inserted into said gap;

a rim coupled to and extending upwardly from said edge of said first plate, said opposing edges of said first plate, and said opposing ends of said pan wherein said rim is configured for retaining the paint on said first plate as the roller is motivated along said first plate from said edge toward said pan, said rim extending along said opposing side edges of said second plate to said endpoint of said second plate wherein said rim is configured for retaining the paint on said second plate as the roller is motivated along said second plate from said endpoint toward said pan;

a protrusion coupled to and extending from an inner surface of said pan proximate to said top of said pan wherein said protrusion is configured for indicating a recommended level of paint to be positioned in said pan, said protrusion extending from said opposing sides of said pan;

indicia coupled to said inner surface of said pan proximate to said protrusion wherein said indicia are configured for labeling said protrusion; and wherein said rod and said pair of bars are positioned for stabilizing said pan on the substantially horizontal surface, wherein said rod is configured for grasping in the hand of the user for lifting said pan, wherein said extrusions are configured for selectively coupling to the step of the ladder inserted into said gap to couple said pan to the ladder, wherein said first plate and said second plate are configured for directing the excess paint from the roller to said pan.

* * * * *